US009734668B2

(12) United States Patent
Nation et al.

(10) Patent No.: US 9,734,668 B2
(45) Date of Patent: Aug. 15, 2017

(54) GAMBLING SMART CARD WITH BETTING LIMITS

(71) Applicants: Owen Nation, Fisherville, KY (US); Carol M. Nation, Fisherville, KY (US)

(72) Inventors: Owen Nation, Fisherville, KY (US); Carol M. Nation, Fisherville, KY (US)

( * ) Notice: Subject to any disclaimer, the term of this patent is extended or adjusted under 35 U.S.C. 154(b) by 88 days.

(21) Appl. No.: 14/757,317

(22) Filed: Dec. 16, 2015

(65) Prior Publication Data

US 2017/0178450 A1 Jun. 22, 2017

Related U.S. Application Data

(60) Provisional application No. 62/124,490, filed on Dec. 22, 2014.

(51) Int. Cl.
*G07F 17/32* (2006.01)

(52) U.S. Cl.
CPC ..... *G07F 17/3251* (2013.01); *G07F 17/322* (2013.01); *G07F 17/323* (2013.01)

(58) Field of Classification Search
CPC ..... G07F 17/3251; G07F 17/323
See application file for complete search history.

(56) References Cited

U.S. PATENT DOCUMENTS 5,910,048 A 6/1999 Feinberg
6,113,493 A 9/2000 Walker et al.
6,629,591 B1 10/2003 Griswold
7,470,191 B2 12/2008 Xidos et al.
7,503,851 B2 3/2009 Walker et al.
7,774,259 B1 8/2010 Satterfield et al.
8,221,225 B2 7/2012 Laut
8,221,245 B2 7/2012 Walker et al.
8,439,746 B2 5/2013 Gagner et al.
8,622,815 B2 * 1/2014 Allen ..... G07F 17/32 273/292
8,672,743 B2 * 3/2014 Walker ..... G06Q 30/06 273/242
2003/0022719 A1 1/2003 Donald et al.
2003/0211886 A1 11/2003 Buchanan et al.
2006/0287072 A1 12/2006 Walker et al.
2012/0289297 A1 * 11/2012 Zilba ..... G07F 17/3244 463/11
2013/0290184 A1 10/2013 Shapiro et al.
2013/0296027 A1 * 11/2013 Gagner ..... G06Q 20/04 463/25
2014/0057703 A1 2/2014 LeStrange et al.
2014/0080583 A1 3/2014 Allen et al.
2014/0087845 A1 3/2014 Schugar
2014/0113707 A1 4/2014 Asher et al.

* cited by examiner

*Primary Examiner* — Dmitry Suhol
*Assistant Examiner* — David Duffy
(74) *Attorney, Agent, or Firm* — Carrithers Law Office PLLC

(57) ABSTRACT

A gambling smart card with betting limits is used in a gambling system. A gambler uses a smart card to place bets in a casino. The bet is reduced by a factor previously chosen by the gambler and agreed to by the casino. The smart card is programmed to reduce the bet by the agreed upon factor or percentage. The player appears to be betting more than the player actually bets because the winnings or losses will be reduced by the agreed upon factor.

3 Claims, 1 Drawing Sheet

GAMBLING SMART CARD WITH BETTING LIMITS

CROSS REFERENCES TO RELATED APPLICATIONS

This application claims priority from U.S. Provisional Application Ser. No. 62/124,490 filed on Dec. 22, 2014 and is incorporated by reference herein in its entirety.

TECHNICAL FIELD

The present invention relates to the field of gambling using smart cards to reduce the player's losses and winnings.

BACKGROUND OF THE INVENTION

Casinos, internet gaming establishments, poker, and lotto as well as horse racing, betting and other gaming establishments attempt to attract gamblers of all types and backgrounds to participate in games in the above fields for purposes of wagering and or gambling. Concern related to credit card gambling problems and underage gamblers has been expressed in the international and national media by governments, religious organizations and the public in general. These groups want the gaming industry, as a whole, to be regulated and to limit gambling on credit, which is seen as a major cause in generating many problems including family debt and poverty, family breakdown and crime.

Many governments regulate existing and new gaming products. However, little attempt has been made to regulate the amount wagered in general or on a weekly or monthly basis or to protect the problem gambler from his addiction. In addition there has been little attempt to protect sensitive financial data pertaining to the player from use including unauthorized use by gaming establishments.

The US Senate has proposed to ban internet gambling in part, due to its not being regulated and its use of unregulated credit card access. Growing concern relative to credit card gambling, problem gamblers and underage gamblers has been expressed in the media by national government, interchurch and other religious anti-gaming lobbying groups, courts, social welfare agencies and the public at large. These groups want the gaming industry as a whole to be regulated.

Gaming involving the automatic limiting of losses has been suggested to help prevent or reduce gambling addiction. Such limitations can help prevent gambling problems but enable players to enjoy gaming without the need of totally giving up gaming entirely because of gambling addictions. This solution creates a win-win situation. Both the casino and the players win because the player doesn't go broke or develop a gambling problem and can therefore continue going to the casino for entertainment.

DESCRIPTION OF THE RELATED ART

US Patent Application Publication No. 20030022719 for REGULATION OF GAMING SYSTEMS by Donald et al which was published on Jan. 30, 2003 limiting wagers preventing wagering after a predetermined amount of losses has been reached, in a predetermined time period.

U.S. Pat. No. 5,910,048 for LOSS LIMIT METHOD FOR SLOT MACHINES by Feinberg which issued on Jun. 8, 1999 teaches a method of operating slot machines to limit a player's losses.

SUMMARY OF THE INVENTION

The present invention provides a gambling smart card with predetermined betting limits established by the player and gambling establishment used in a gambling system. A gambler uses a smart card to place bets in a casino. The bet is reduced by a factor previously chosen by the gambler and agreed to by the casino. The smart card is programmed to reduce the bet by the agreed upon factor or percentage. The player appears to be betting more than the player actually bets because the winnings or losses will be reduced by the agreed upon factor.

In accordance with the present invention, there is provided a casino gambling system comprising, or consisting of a central casino computer connected to gaming machine stations and gaming table stations. The central casino computer is programmed to be capable of tracking a player or player's apparent winnings and losses using attached card readers reading a player's smart gaming card used during gaming, and of calculating actual winnings and losses by multiplying the apparent winnings or losses by a percentage value chosen by the player at the beginning of the gambling session to calculate the player's actual winnings and losses. The central computer is capable of monitoring money left on the smart card during gaming and refusing play when the money left on the smart gaming card is totally depleted. The system further includes a welcome kiosk in communication with the central casino computer, which is capable of reading and programming the smart gaming card with the percentage value and with start money with which to gamble, based on selections made by the player.

The method of casino gambling comprises or consists of the steps of providing a gambling player with a smart gaming card and using a welcome kiosk with a card reader to enter a percentage value on the smart gaming card. The percentage value is used to reduce amounts of winnings and losses from gambling. The player uses the welcome kiosk with a card reader to add "start money" to the smart gaming card. The card allows the player to gamble on various gaming machines and at various gaming tables while using the smart card for gambling. The gaming machines and the gaming tables including stations with card readers in communication with the central casino computer. The player is allowed to collect the winnings and losses at the welcome kiosk when gaming is completed by inserting the smart gaming card and requesting a pay out.

The following outline and descriptions explain a new and novel approach to casino gambling in the ever changing and more competitive market that vies for the discretionary income of the average recreational player. This approach may be a good interim approach for the novice gambler or person who may have a gambling problem.

It is an object of this invention to provide a gaming system providing a method of gambling wherein the amount which is gambled at each bet is automatically reduced by a percentage by the central casino computer, thus decreasing the actual amount which a player can win but also decreasing the amount which a player can lose.

It is an object of this invention to provide a gaming system which allows a player to select gambling limits which will then be programmed into a smart card and will automatically prevent him from losing more the selected amount.

It is an object of this invention to provide a gaming system wherein the actual winnings or losses of every bet is determined by multiplying the bet by a factor (for example: 20%) so that the winnings or losses resulting from the bet will be lessened by that factor.

It is an object of this invention to provide a gaming system wherein the casino gaming computer system includes a smart card reader device connected with each gambling device in the casino (including slot machines and card tables) and a software program which enables a percentage value to be programmed onto the smart gaming card as well as an actual total amount of money with which to gamble.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
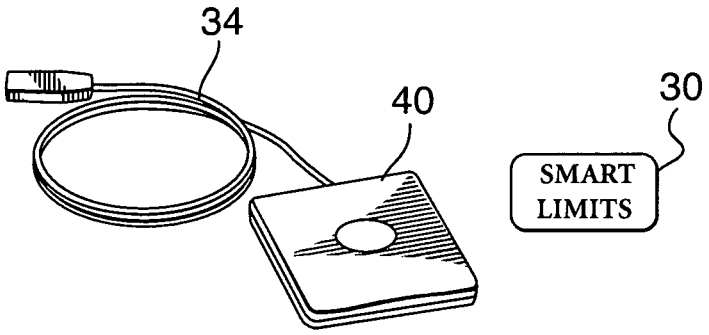
FIG. 1 is a front view of a smart limits card and a card reader.
Figure 2:
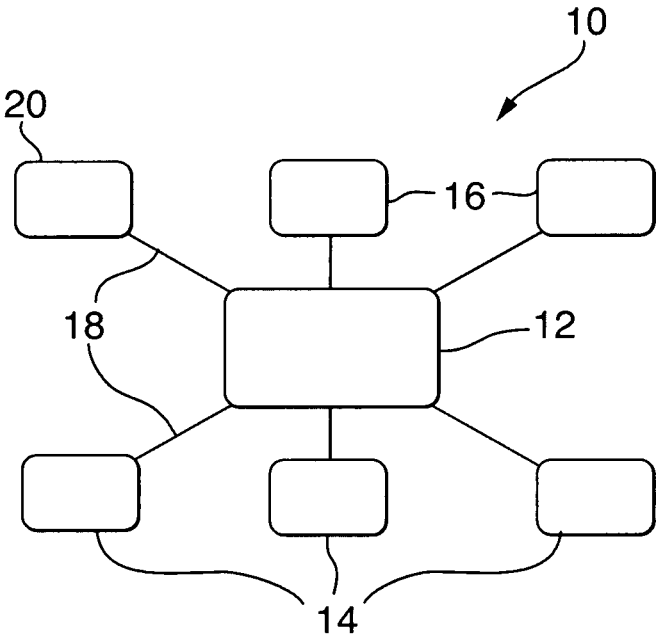
FIG. 2 is a block diagram of a smart limits gambling system.

In accordance with the present invention, there is provided a smart limits gambling system 10 which includes a welcome kiosk 20, gaming machine stations 14, and gaming table stations 16 connected to a central casino computer 12. The welcome kiosk 20, gaming machine stations 14, and gaming table stations 16 each have a smart card reader 40 which reads a player's smart card to identify the player and to quantify bets, winnings and losses and assign those winnings or losses to a player who has just gambled at that station. The welcome kiosk 20 is capable of programming a smart gaming card 30 and loading the smart limits gaming card 30 with an actual amount of starting money from perhaps the player's credit account or from his actual cash in hand. The smart gaming card is also programmed with a percentage value which a player selects at the welcome kiosk.

As the player goes from one to the other of the gaming machines or tables, the player inserts the card into a card reader 34 at the gaming station associated with the gaming machine or gaming table. The player is allowed to gamble if the smart card has cash left on it. The player bets a perceived or apparent amount but the actual value the player is betting is reduced by the percentage value which the player has chosen at the welcome kiosk 20. The apparent winnings or losses are based on the apparent amount the player bets, but the actual winnings or losses are determined by reducing the apparent amount bet by the "percentage value" that the player presets at the welcome kiosk 20. The player continues to play on machines or tables, and if the player loses all of the "starting money" which the player initially put on his smart gaming card, the player is not allowed to play until the player adds more money to the smart gaming card. When the player is ready to quit, the actual winnings or losses which have been tallied by the central casino computer 12 as play progressed through the gambling session will be available to the player. The actual value of the winnings and losses will be the perceived or apparent amounts of the winnings or losses multiplied by the percentage value which the player set up at the welcome kiosk.

Another embodiment of the smart limits gambling system has a welcome desk, rather than a welcome kiosk, where a casino employee welcomes the player and programs his smart card with the percentage value and adds "start money". The welcome desk has a station which communicates this information to the central casino computer.

Method of Use:

A method of casino gambling comprising or consisting of the steps of connecting a central casino computer to a gaming machine station and a gaming table station. Providing a gambling player with a smart gaming card. Programming the central casino computer to track a player's winning amount and a losing amount using a card reader for reading a player's smart gaming card. Calculating a winning amount and a losing amount. Multiplying the winning amount or the losing amount by a selected percentage value preset on the smart gaming card. Reducing the winning amount or the losing amount by the percentage value. Allowing the player to gamble on various gaming machines and at various gaming tables while using the smart card for gambling. Said gaming machines and the gaming tables including stations with card readers in communication with the central casino computer. Allowing the player to collect the winnings and losses at the kiosk when gaming is completed by inserting the smart gaming card into the kiosk and requesting a pay out.

Player Limits

The average recreational player wants to enjoy the casino atmosphere but wants to limit risk to the all of the money. The smart limits system allows the player to control the risk prior to the gaming experience. This approach allows the player to sample the approved casino game outlets without consciously worrying about losses and risk during the experience. The player has the opportunity to obtain an electronic card that would allow them to have preset percentage loss and gain limits. The player has control of his total loss amounts based on his previously chosen limits. This allows the player to play and enjoy any approved games the same as the routine gambler. He would enjoy the betting process and winning process the same as any normal player. The only difference would be at the end of the gambling experience. The player has a preset percentage applied to his losses or gains. The "cash out" is based on the preset percentage. The player's total winnings or losses would be multiplied by the agreed to percentage amount to determine the actual winnings or losses. During play, the player appears to be winning or losing the full amount as shown on the machine or at the gambling table but at the end of the night, the apparent amount is reduced by multiplying the apparent losses or winnings by the percentage value.

Casino Limits

The casino would enjoy the same benefits as the player. The player chooses the percentage smart limits option or options set by the casino. The player enjoys the casino and experiences the excitement of any routine or seasoned player on the approved games. The results at the end of the gaming experience are adjusted based on the smart limits percentage. The casino only earns a percentage of the losses the player experienced. The casino is only liable for the percentage of winnings that was preset. It is up to each casino that participates in the smart limits gambling experience to set the percentage options available to their clients. For example, the casino may allow a gambler to preset his percentage range to any value between 1 and 100. Other casinos may require the percentage be at least 10% or even a higher value. This lower limit is controlled by the casino.

Player Control

The concept of smart limits allows the player to have control over their risk without making conscious, calculating decisions as the player enjoys their gambling experience. The player decides prior to the gambling experience what percentage of risk the player would like with relation to the bets. The player gives his smart card to the casino clerk who then programs the card with the reduction factor for use in the casino computer system. The player may also put a total losses limit on the smart card as well. The player can then enjoy themself, and not worry about the external forces that may affect his judgement during the gaming experience. Examples of such forces include socializing while gambling, partaking of alcoholic beverages, and just fatigue during his experience. The player will be able to visit the casino more often and use it more for entertainment because, overall, the player doesn't lose or win as much per visit. The average player does not want to risk the total amount of discretionary income. The player's limits are automatically reduced by the percentage programmed into the card. The player can now enjoy gaming with a much lower risk. The earnings to the casino by these player may not be as great. However, the player is not likely a routine gambler. The smart limits card gaming system is a gateway to allow the infrequent gambler to enjoy the casino as entertainment. This gaming experience would compete with other entertainment choices such as movies, bowling, etc. and is very friendly for fixed income players.

Another advantage of the smart limits gambling concept is the risk/benefit ratios for fixed income players. These players have a reason to frequent the casino with a limited risk. This allows casino gambling to be viewed as more of an entertainment service. The participation of these players allows the casino to enhance revenue not only from increased numbers by players taking advantage of smart limits, but also the ancillary services provided by the casino. Examples include shopping, eating and lodging. The casino may require that the player opts out of all extra reward points, perks, and promotions from the casino. The smart limits player might not be eligible for promotional programs or opportunities. The casino may now be limited in its winning percentage. The casino makes the decision to limit additional perks or promotions for the player based on market competition and numbers. The special smart limits card will have to be issued to distinguish the smart limit player from a regular player, but the smart limit player has the option to have a regular card for regular play. The smart limits card is issued to safeguard the player's losses and winnings as indicated by previous choices. If the player so chooses, the player may have a second regular card and play that card at any time. The player now feels as if the player has control based on how the player perceives the need for betting.

Example 1: Smart Limits Card Gaming System

The player is issued a smart limits card. The player loads his smart card with an actual value of $2,000 and to set his percentage value at 20% risk if the casino approves. The loss risk is only 20% of losses up to a total of the entire sum on card. If the player wins $10,000.00 from his gaming efforts the casino would only be liable for $2,000.00 due to the 20% risk set by the player and/or casino. If the player loses an apparent value of $10,000.00 from his gaming efforts the player is actually only liable for $2,000.00. Because his initial actual value on the smart card was $2000, when his apparent losses reach $10,000, the player is out of money on the card and must stop gambling or must put more money on the card.

Because the apparent gaming values are actually five times the actual values, the perceived bets are more exciting during play, but when the night is over, the party's losses are only one fifth of the apparent values. This is obviously a benefit to the player. However, if the player wins big, his actual winnings are only one fifth of the apparent value. This may seem to be a big negative, but one good thing here is that a big wining night will cause some players to gamble that much more often and eventually to lose much more. Smaller actual winnings will lessen this tendency and therefore, be a plus in the longer term.

The player has the perception of control of his potential losses. The player enjoys the gambling experience due to security of the smart limits card and now can view casino gambling as entertainment venue like shopping, movie-watching, or similar options due to perception of affordability.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. A casino gambling system comprising:

a central casino computer connected to a gaming machine station or a gaming table station;

a kiosk in communication with said central casino computer, said kiosk programming a smart gaming card inserted in said kiosk with a percentage value based on a selection made by a player at a beginning of a gambling session and a selected amount of money with which to gamble based on an input made by said player;

said central casino computer including programming that tracks a winning amount and a losing amount of said player by using a card reader at said gaming machine station or said gaming table station that reads said smart gaming card during said gambling session and calculates an actual winning amount and an actual losing amount by multiplying said winning amount and said losing amount by said percentage value to calculate said actual winning amount and actual losing amount;

said central computer monitoring a remainder of money left on said smart gaming card during gaming based on said actual winning and losing amounts and inactivating play when said remainder of money is depleted below a preset value; and said kiosk providing said player with said remainder of money when gaming is completed when said player inserts said smart gaming card into said kiosk and requests a pay out.

2. A method of casino gambling including the steps of:

connecting a central casino computer to a gaming machine station or a gaming table station;

providing a player with a smart gaming card;

programming said central casino computer to track said player's winning amount and a losing amount using a card reader at a station of said gaming machine station or said gaming table station for reading said player's smart gaming card;

calculating, by the central casino computer, an actual winning amount and an actual losing amount;

multiplying, by the central casino computer, said winning amount and said losing amount by a percentage value selected by said player preset on said smart gaming card to determine said actual winning amount and said actual losing amount respectively;

allowing said player to gamble on said gaming machines and at said gaming tables while using said smart gaming card for gambling; and allowing said player to collect said actual winnings and actual losses at a kiosk when gaming is completed by inserting said smart gaming card into said kiosk and requesting a pay out.

3. A casino gambling system consisting of:

a central casino computer connected to a gaming table or a gaming machine station;

a kiosk in communication with said central casino computer, said kiosk programming a smart gaming card inserted in said kiosk with a percentage value based on a selection made by a player at a beginning of a gambling session and a selected amount of money with which to gamble based on an input made by said player;

said central casino computer including programming that tracks a winning amount and a losing amount of said player by using a card reader at said gaming table or said gaming machine station that reads said smart gaming card during said gambling session and calculates an actual winning amount and an actual losing amount by multiplying said winning amount and said losing amount by said percentage value to calculate said actual winning amount and actual losing amount;

said central computer monitoring a remainder of money left on said smart gaming card during gaming based on said actual winning and losing amounts and inactivating play when said remainder of money is depleted below a preset value; and said kiosk providing said player with said remainder of money when gaming is completed when said player inserts said smart gaming card into said kiosk and requests a pay out.

* * * * *